US009441421B2

(12) United States Patent
Curlett et al.

(10) Patent No.: US 9,441,421 B2
(45) Date of Patent: Sep. 13, 2016

(54) TOOTH FOR ROLLER CRUSHER

(71) Applicant: Bradken Canada Manufactured Products LTD., Edmonton (CA)

(72) Inventors: Jonathan Daniel Curlett, Edmonton (CA); Nolan Brian Serink, Waunakee, WI (US)

(73) Assignee: Bradken Canada Ltd., Edmonton, Alberta (CA)

( * ) Notice: Subject to any disclaimer, the term of this patent is extended or adjusted under 35 U.S.C. 154(b) by 423 days.

(21) Appl. No.: 14/156,151

(22) Filed: Jan. 15, 2014

(65) Prior Publication Data

US 2014/0196957 A1 Jul. 17, 2014

Related U.S. Application Data

(60) Provisional application No. 61/752,801, filed on Jan. 15, 2013.

(51) Int. Cl.

| | |
|---|---|
| ***B02C 4/30*** | (2006.01) |
| ***E21B 10/48*** | (2006.01) |
| ***E21C 25/10*** | (2006.01) |
| ***E21C 35/193*** | (2006.01) |

(52) U.S. Cl.

CPC ..... *E21B 10/485* (2013.01); *B02C 4/305* (2013.01); *E21C 25/10* (2013.01); *E21C 35/1933* (2013.01)

(58) Field of Classification Search

CPC ..... B02C 4/30; B02C 4/305; E21B 10/485; E21C 35/1933; E21C 25/10

USPC ..... 241/294

See application file for complete search history.

(56) References Cited

U.S. PATENT DOCUMENTS

| | | | | |
|---|---|---|---|---|
| 5,098,167 | A * | 3/1992 | Latham | E21C 35/1933 299/104 |
| 6,626,500 | B1 * | 9/2003 | Cribb | E02F 3/205 299/39.8 |
| 6,742,735 | B2 * | 6/2004 | Sollami | B21J 5/02 241/294 |
| 2015/0054332 | A1 * | 2/2015 | Latham | B28D 1/188 299/39.8 |

* cited by examiner

*Primary Examiner* — Mark Rosenbaum

(74) *Attorney, Agent, or Firm* — LeClairRyan, a Professional Corporation

(57) ABSTRACT

An improved tooth for a roller crusher is presented. The tooth can include a first tungsten carbide overlay layer plasma-transfer arc welded on a recessed hemispherical end of the tooth, which is covered by a wearable cap placed over the first overlay layer, the cap welded to the tooth. A second tungsten carbide overlay layer can then be plasma-transfer arc welded over the cap to, thereby, provide a tooth having two tungsten carbide overlay wear layers.

23 Claims, 19 Drawing Sheets

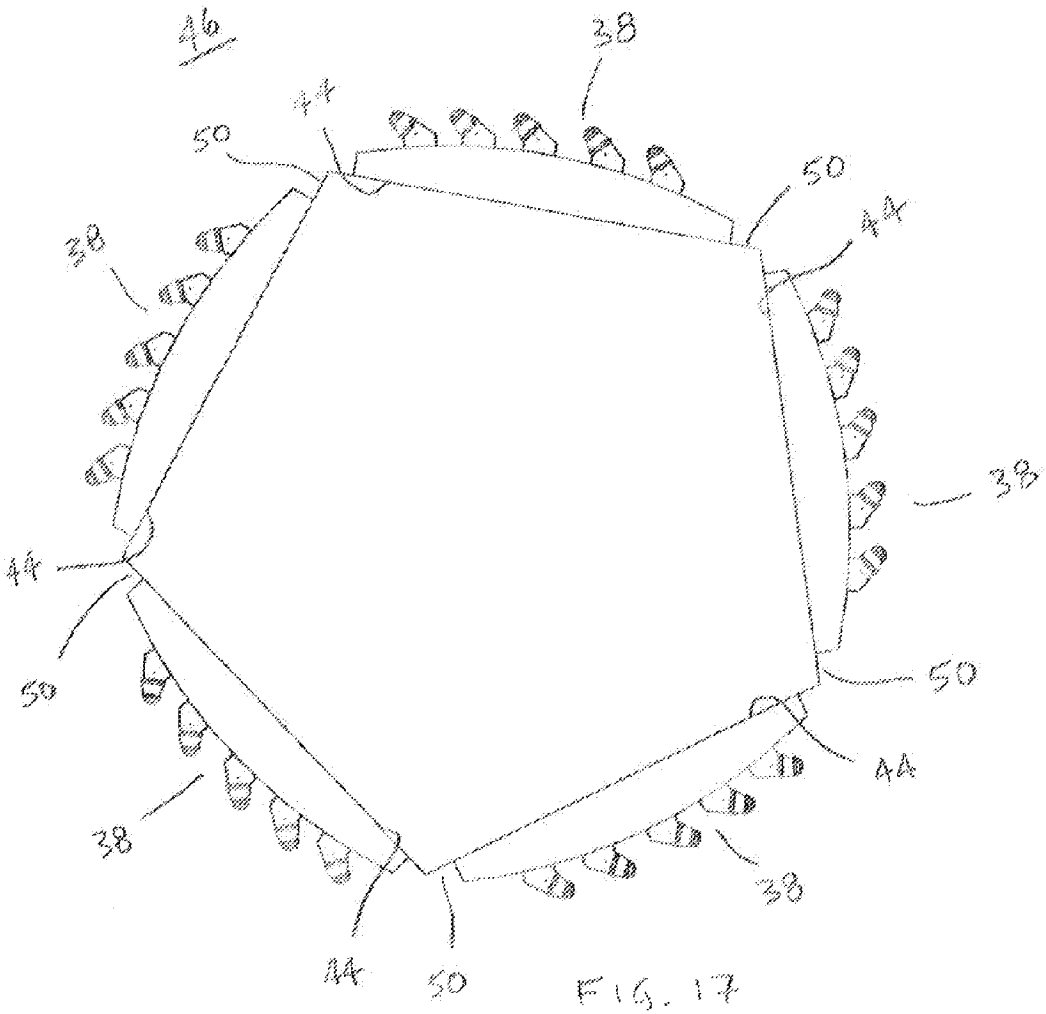
38
50
44
50
44
38
50
44
38
50
44
38

TOOTH FOR ROLLER CRUSHER

This application claims the benefit of U.S. Provisional Patent Application Ser. No. 61/752,801, filed Jan. 15, 2013, which is hereby incorporated by reference in its entirety.

FIELD OF THE INVENTION

The present disclosure is related to the field of replaceable teeth for use with machinery such as roller crushers, and more particularly, for replaceable teeth having tungsten carbide overlay layers.

BACKGROUND OF THE INVENTION

Rotary or roller crushing units (also known as "crushers") can be used for crushing or sizing oil sands immediately taken from haul trucks or other vehicles prior to secondary sizing using crushers, breakers and vibratory screens. Oil sands can contain both soft chunks of ore that are clumped together, as well as heavier and denser chunks. The oil sands can also include solid rock that is capable of shearing a crusher tooth completely off of the crusher.

An example of a known design of a crusher tooth is shown in FIGS. 1A and 1B. A tooth of this design may have a mass of roughly 20 kg, and is approximately 283 mm tall and 160 mm in diameter at its extremities. A typical design includes a forged 4340QT blank in the rough shape of tooth (A) that is then machined to size, and robotically overlaid with tungsten carbide overlays (B), (C) and (D) using plasma-transfer arc welding ("PTAW"). Overlay (B) is approximately 6 mm thick, whereas overlay (C), placed adjacent to overlay (B), and overlay (D), placed around the circumference of tooth (A), are approximately 3 mm thick. In some embodiments, overlay (C) is a 3 mm layer of tungsten carbide applied to tooth (A) first, with a second 3 mm layer of tungsten carbide applied on top of overlay (C) to form overlay (B).

A problem with this prior art design is that the thickness of each tungsten carbide overlay layer is limited by practical adhesion limits. Tungsten carbide cannot be reliably overlaid onto a tooth in thicknesses greater than 6 mm without experiencing overlay degradation and delamination. In other words, the overlay thickness cannot simply be increased to achieve improved wear life. Crusher teeth of this design can have a wear-life of as little as 5 weeks, and even less in winter months or under harsh operating conditions.

It is, therefore, desirable to provide an improved tooth for a roller crusher that overcomes the shortcomings of the prior art.

SUMMARY OF THE INVENTION

An improved tooth for a roller crusher having extended wear life is provided. The tooth can include a first tungsten carbide overlay layer plasma-transfer arc welded onto a recessed hemispherical end of the tooth. A wearable cap can be placed over the first overlay layer, and then welded to the tooth. A second tungsten carbide overlay layer can then be plasma-transfer arc welded over the cap to provide a tooth having two tungsten carbide overlay wear layers.

Broadly stated, in some embodiments, a tooth for a roller crusher is provided, the tooth including: an attachment end configured for releasable attachment to the roller crusher, a waist and a conical body extending from the waist away from the attachment end; a recessed hemispherical end disposed on the conical body; a first terrace disposed on the tooth adjacent to the recessed spherical end; a second terrace disposed on the tooth between the first terrace and the conical body; a first tungsten carbide layer disposed on the spherical end; a cap disposed on the spherical end, the cap covering the first tungsten carbide layer; and a second tungsten carbide layer disposed on the cap.

Broadly stated, in some embodiments, an improved platen for a roller crusher is provided, the platen having a bottom surface for attachment to the roller crusher and a convex surface disposed above the bottom surface, the platen further having a plurality of tooth bases disposed on the convex surface, at least one improved tooth disposed in one of the tooth bases, each improved tooth including: an attachment end configured for releasable attachment to one of the tooth bases, a waist and a conical body extending from the waist away from the attachment end; a recessed hemispherical end disposed on the conical body; a first terrace disposed on the tooth adjacent to the recessed spherical end; a second terrace disposed on the tooth between the first terrace and the conical body; a first tungsten carbide layer disposed on the spherical end; a cap disposed on the spherical end, the cap covering the first tungsten carbide layer; and a second tungsten carbide layer disposed on the cap.

Broadly stated, in some embodiments, an improved roller crusher is provided, the crusher including a drum configured to receive a plurality of platens, each platen having a bottom surface for attachment to the roller crusher and a convex surface disposed above the bottom surface, the platen further having a plurality of tooth bases disposed on the convex surface, at least one improved tooth disposed in one of the tooth bases, each improved tooth including: an attachment end configured for releasable attachment to one of the tooth bases, a waist and a conical body extending from the waist away from the attachment end; a recessed hemispherical end disposed on the conical body; a first terrace disposed on the tooth adjacent to the recessed spherical end; a second terrace disposed on the tooth between the first terrace and the conical body; a first tungsten carbide layer disposed on the spherical end; a cap disposed on the spherical end, the cap covering the first tungsten carbide layer; and a second tungsten carbide layer disposed on the cap.

Broadly stated, in some embodiments, the first tungsten carbide layer can abut the first terrace, the cap can be welded to the tooth, one or both of the first and second tungsten carbide layers can be plasma-transfer arc welded to the tooth, and the cap can abut the second terrace.

Broadly stated, in some embodiments, the improved tooth may be used with a mineral sizer.

BRIEF DESCRIPTION OF THE DRAWINGS

FIG. 17 is a side elevation view depicting the roller crusher of FIG. 15.

FIG. 18 is a side view depicting a mineral sizer having a plurality of roller platen assemblies according to the invention.

DETAILED DESCRIPTION OF THE INVENTION

Figure 1B:
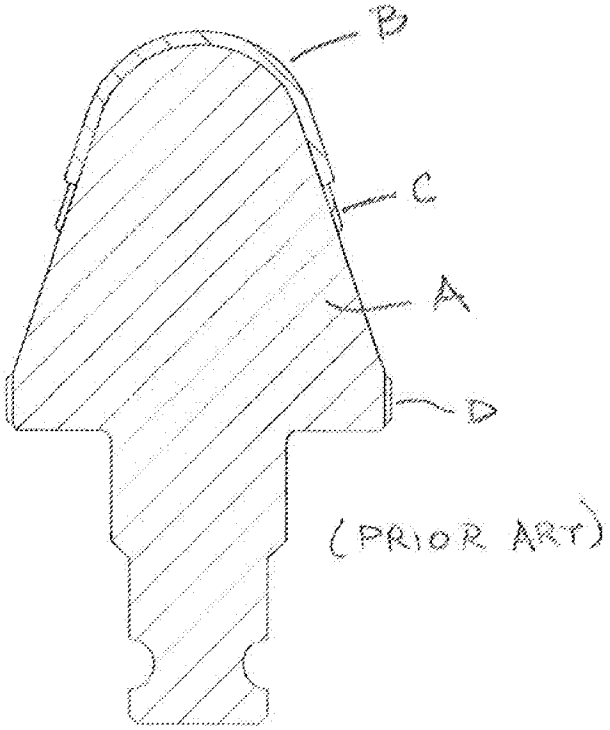
FIG. 1B is a cross section elevation view depicting the prior art tooth of FIG. 1 with a tungsten carbide overlay.
Figure 1A:
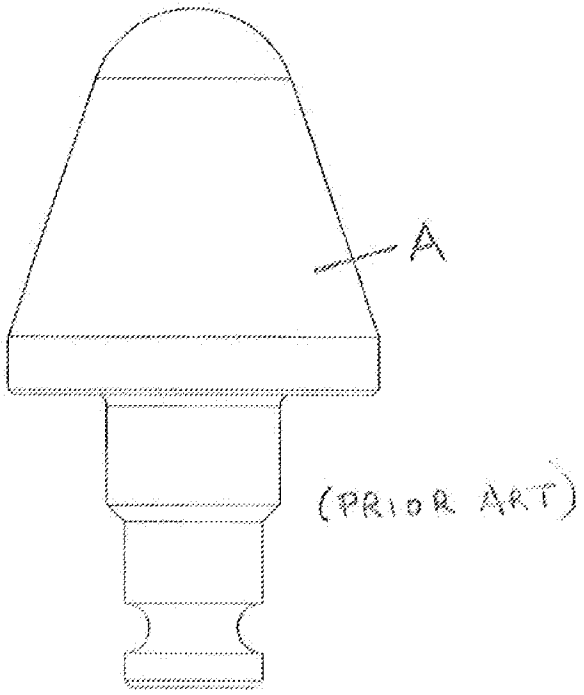
FIG. 1A is a side elevation view depicting a prior art tooth for a roller crusher, shown without a tungsten carbide overlay.
Figure 2:
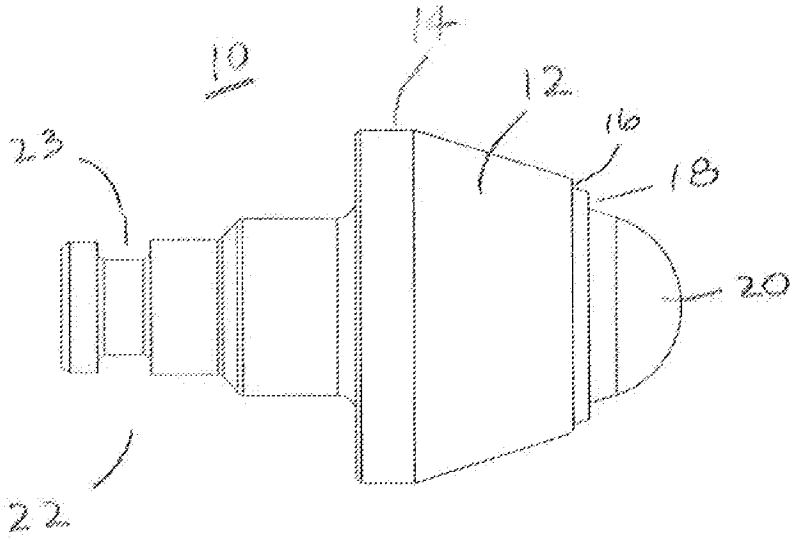
FIG. 2 is a side elevation view depicting an improved tooth for a roller crusher.
Figure 3:
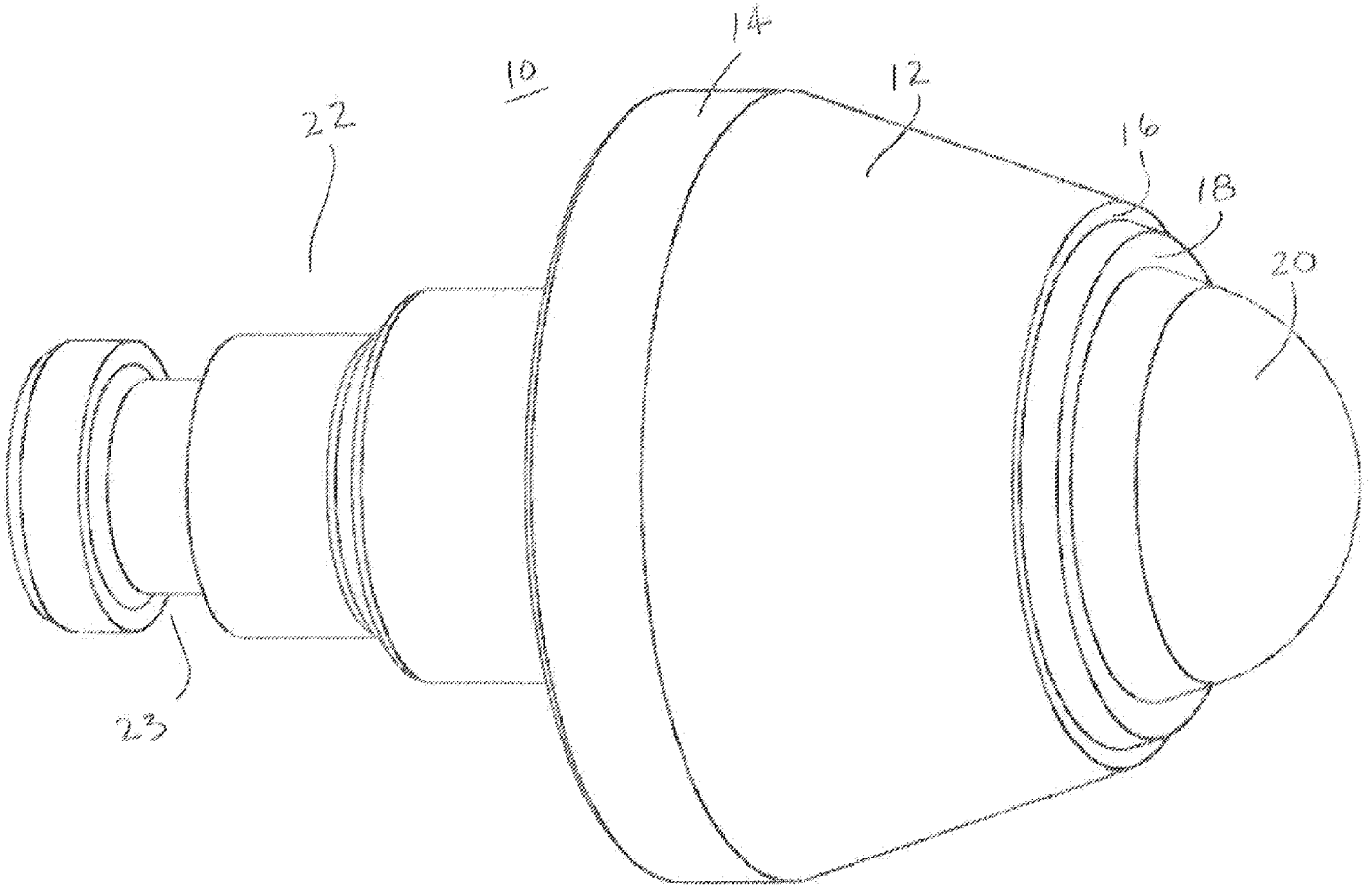
FIG. 3 is a perspective view depicting the improved tooth of FIG. 2.

An improved tooth for a roller crusher is provided. Referring to FIGS. 2 and 3, an embodiment of improved tooth 10 is shown. In this embodiment, tooth 10 has a conical body 12 adjacent to waist 14 that is, in turn, adjacent to attachment end 22, which can be configured to releasably attach to a platen, roller crusher or mineral sizer. In some embodiments, attachment end 22 includes notch 23 for attachment to a tooth base, as described in more detail below. Tooth 10 can have a recessed hemispherical end 20 on one end thereof, and terrace 16 adjacent to conical body 12 and terrace 18 adjacent to hemispherical end 20.

Figure 4:
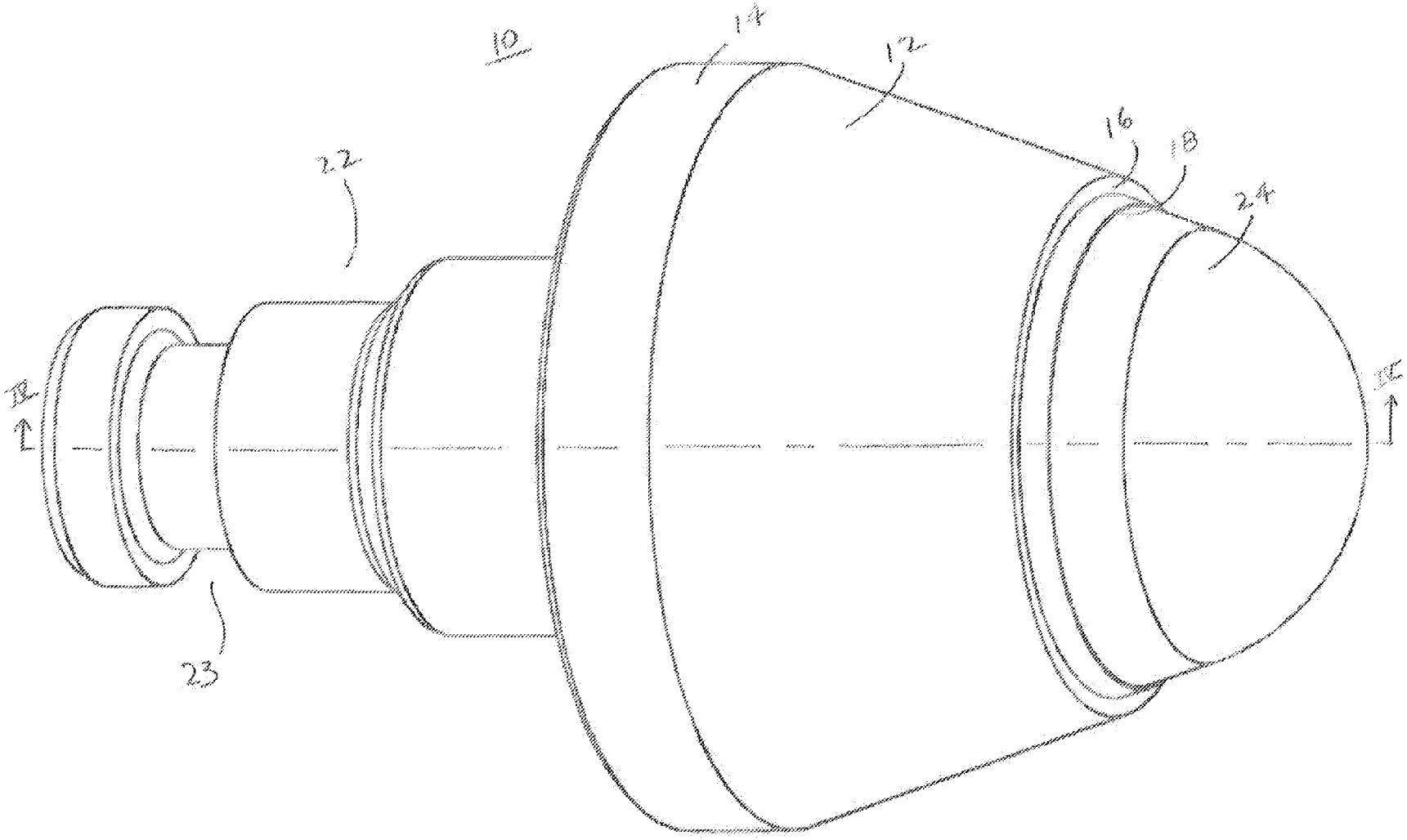
FIG. 4 is a perspective view depicting the improved tooth of FIG. 2 with a first layer of tungsten carbide overlaid on the end of the tooth.
Figure 5:
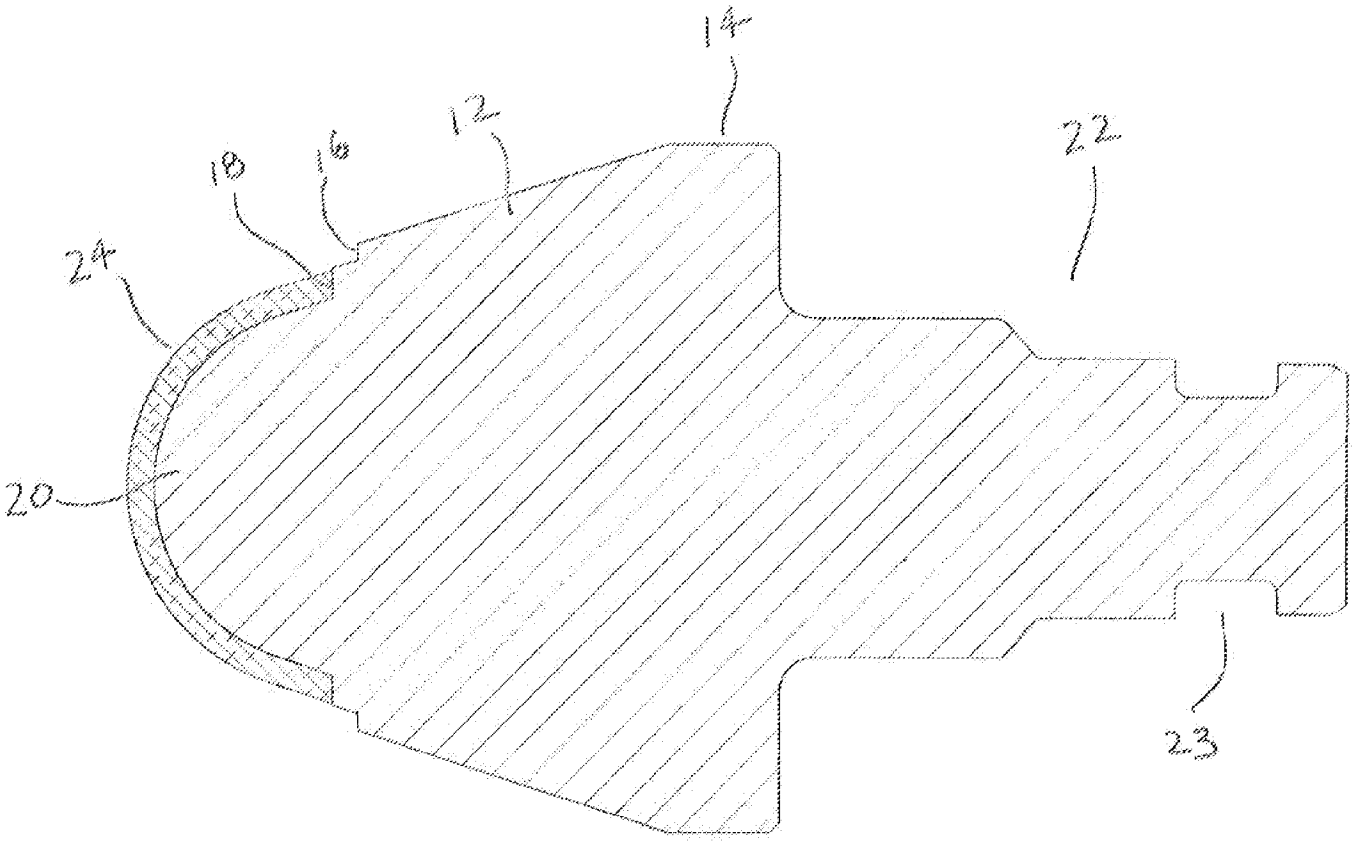
FIG. 5 is a cross-sectional side elevation view depicting the improved tooth of FIG. 4 taken along section lines IV-IV.

Referring to FIGS. 4 and 5, an embodiment of tooth 10 is shown including first tungsten carbide layer 24 disposed onto hemispherical end 20. In some embodiments, tungsten carbide layer 24 can be applied to hemispherical end 20 using a PTAW technique. In some embodiments, tungsten carbide layer 24 can be up to approximately 6 mm thick. In further embodiments, as shown in FIG. 5, tungsten carbide layer 24 can be applied to hemispherical end 20 such that the layer abuts terrace 18.

Figure 7:
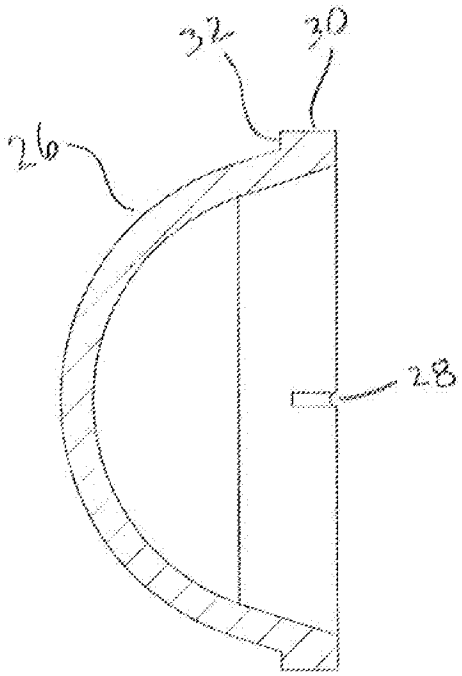
FIG. 7 is a cross-sectional side elevation view depicting the cap of FIG. 6 taken along section lines VI-VI.
Figure 6:
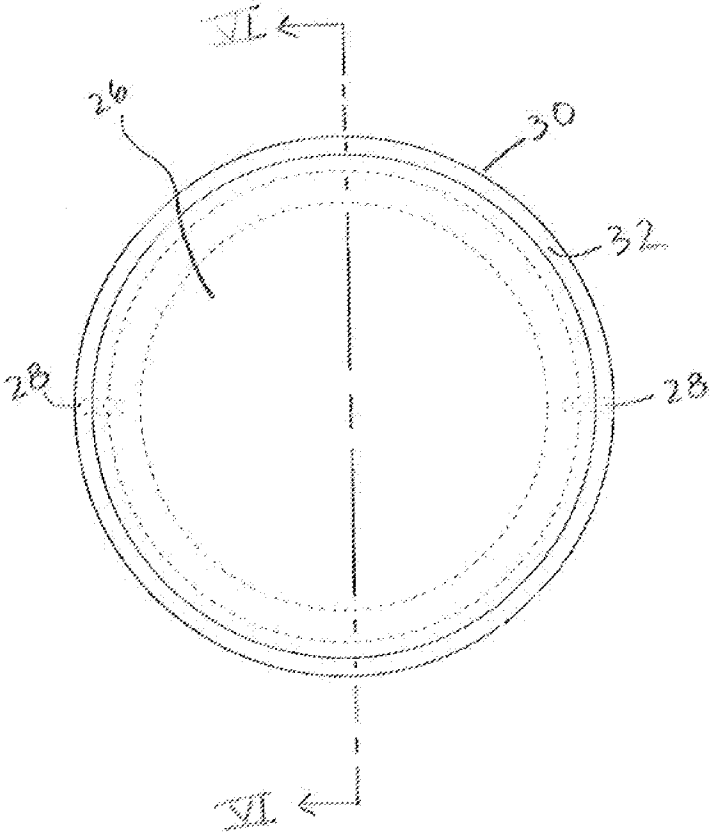
FIG. 6 is an end elevation view depicting a cap for the improved tooth of FIG. 2.

Referring to FIGS. 6 and 7, cap 26 is shown. In some embodiments, cap 26 has a hemispherical body, and further includes at least one notch 28 disposed in cap waist 30. In some embodiments, notch 28 can be a minimum of 3 mm wide, a minimum of 1 mm deep and a minimum of 10 mm long. Notch 28 can allow gas to escape during a final weld of cap 26 to tooth 10, as described in further detail below. In further embodiments, cap waist 30 can further comprise terrace 32 configured thereon.

Figure 8:
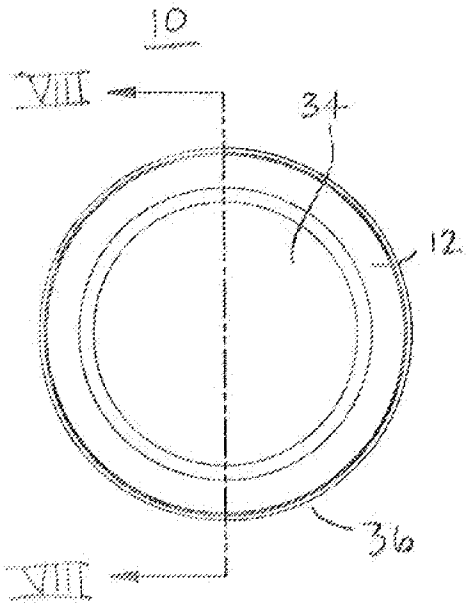
FIG. 8 is an end elevation view depicting the improved tooth of FIG. 4 with the cap of FIG. 6 placed thereon, and a second layer of tungsten carbide overlaid on the cap.
Figure 9:
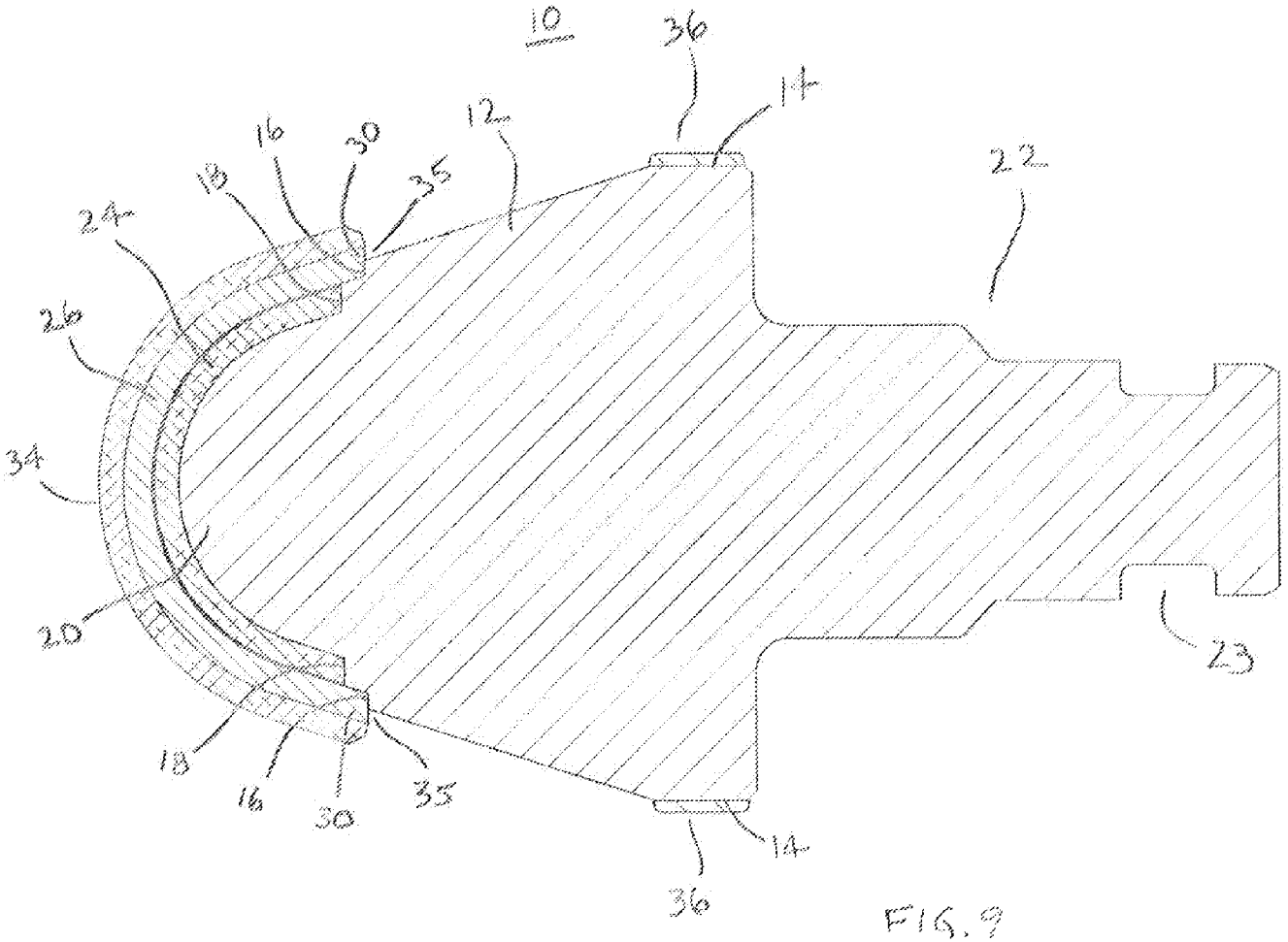
FIG. 9 is a cross-sectional side elevation view depicting the improved tooth of FIG. 8 taken along section lines VIII-VIII.
Figure 10:
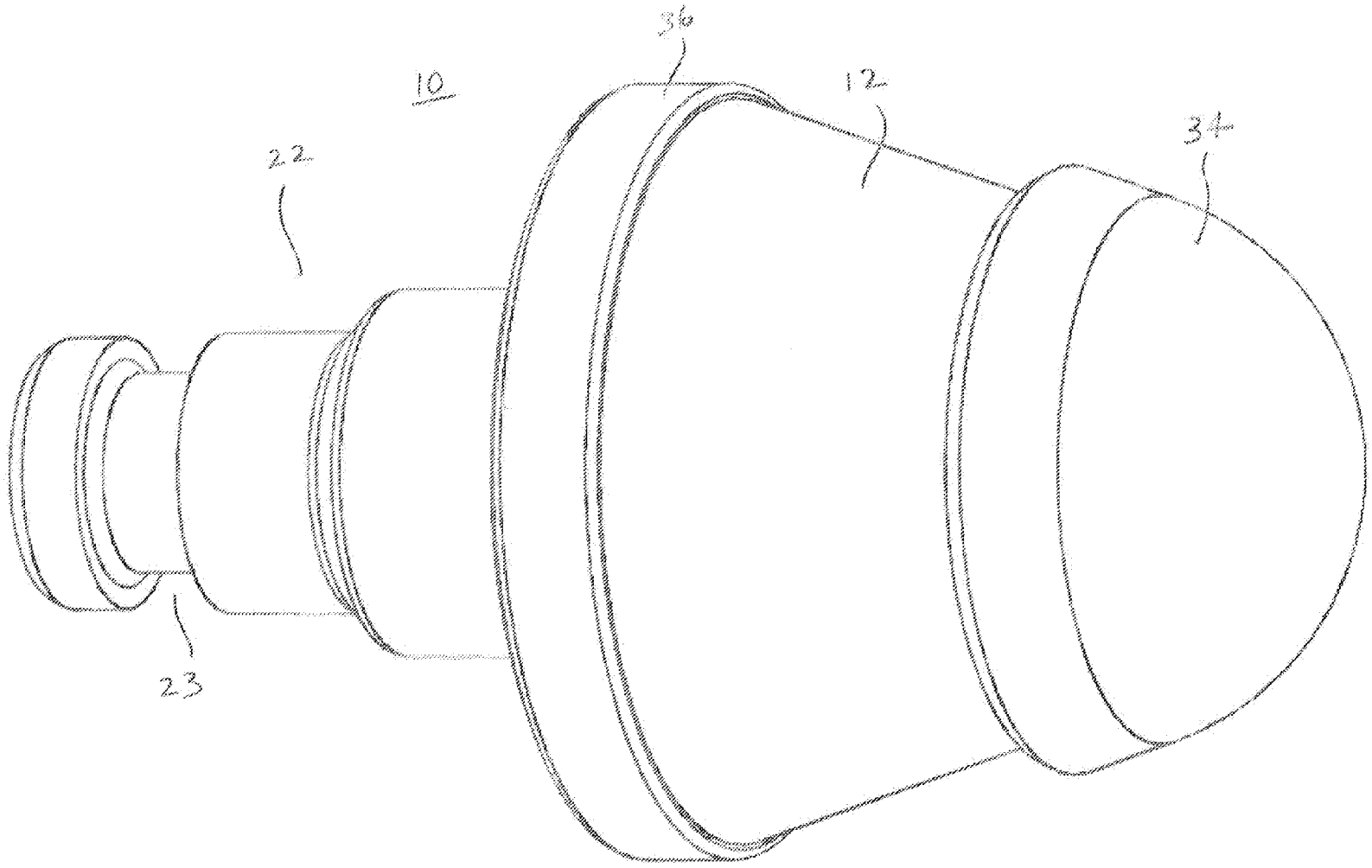
FIG. 10 is a perspective view depicting the improved tooth of FIG. 8.
Figure 11:
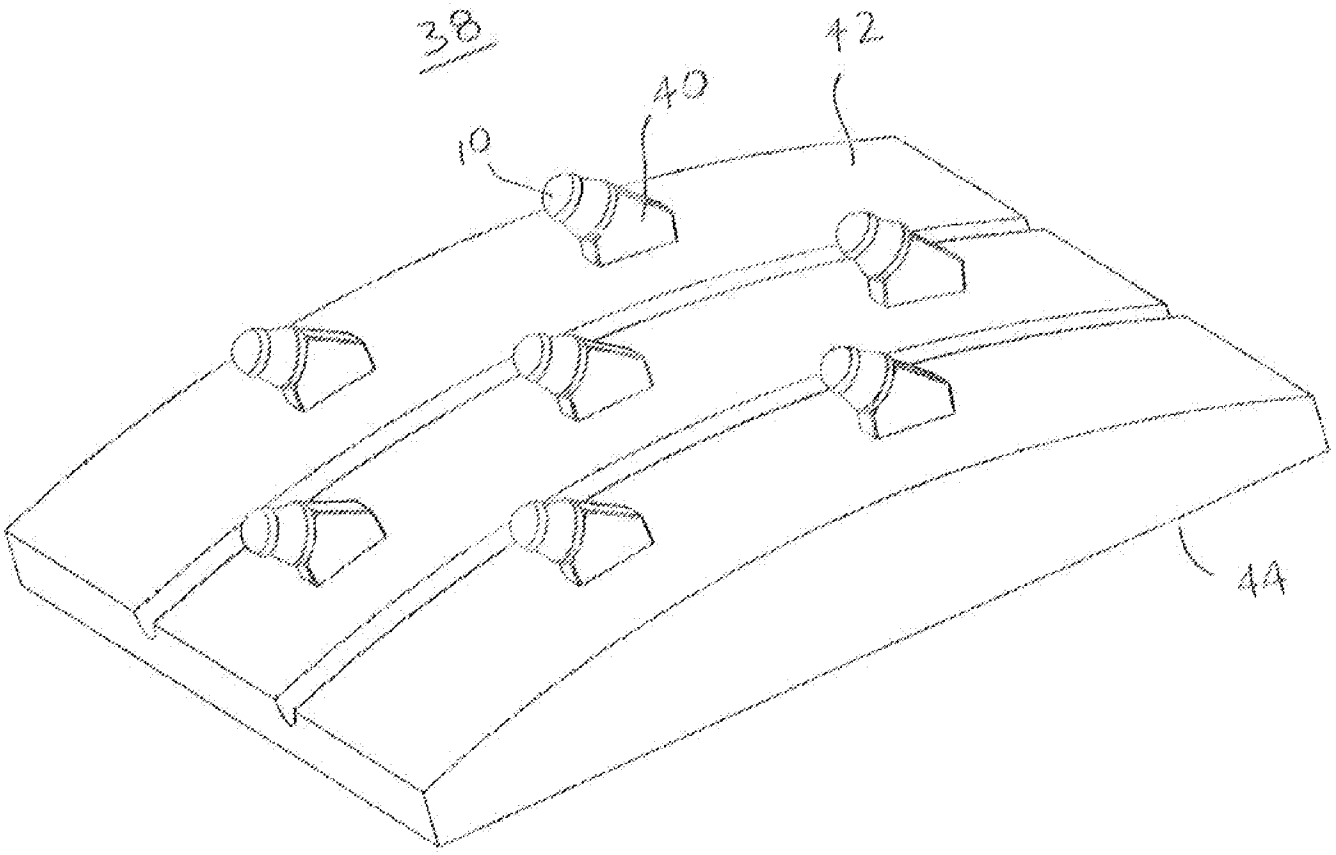
FIG. 11 is a perspective view depicting a roller platen assembly having a plurality of the improved teeth of FIG. 8.
Figure 12:
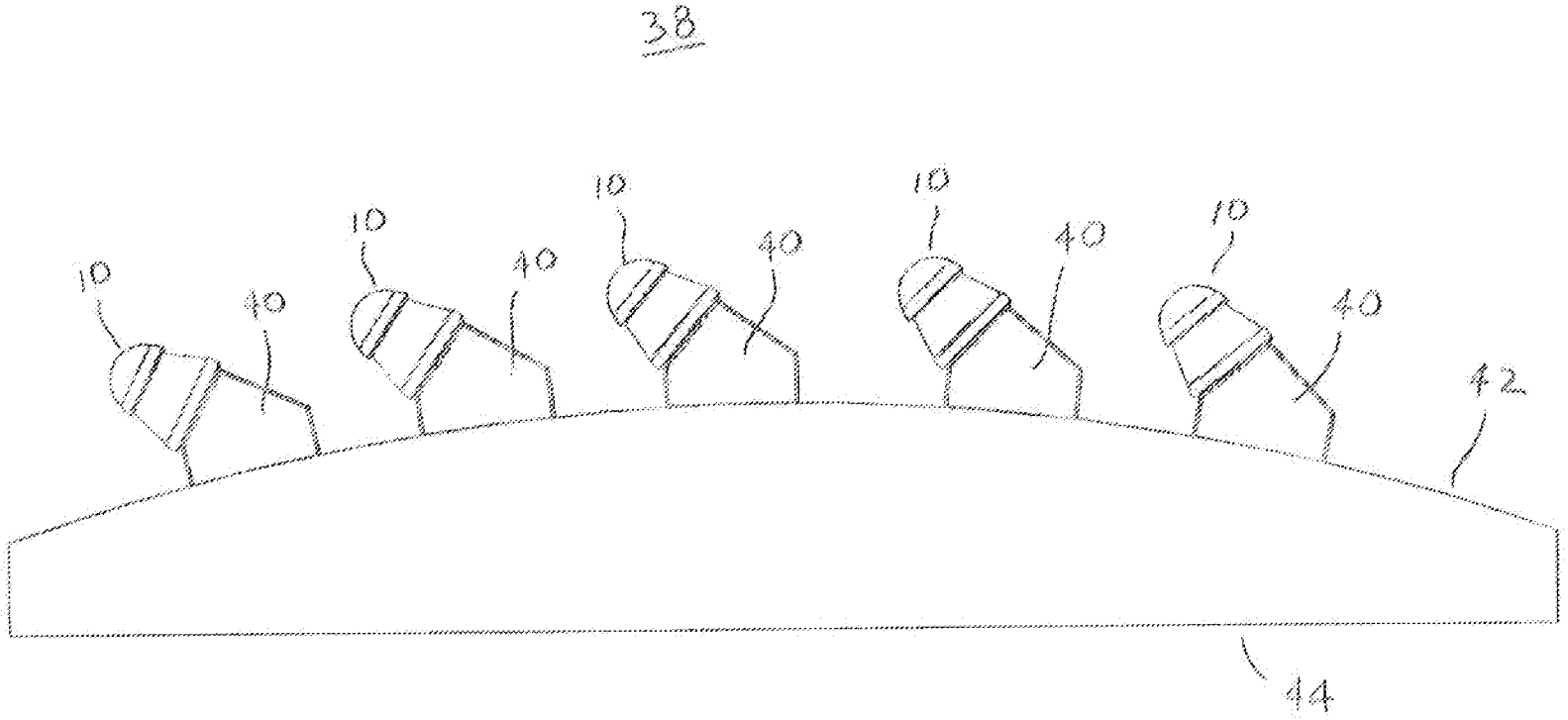
FIG. 12 is a side elevation view depicting the roller platen assembly of FIG. 11.
Figure 13:
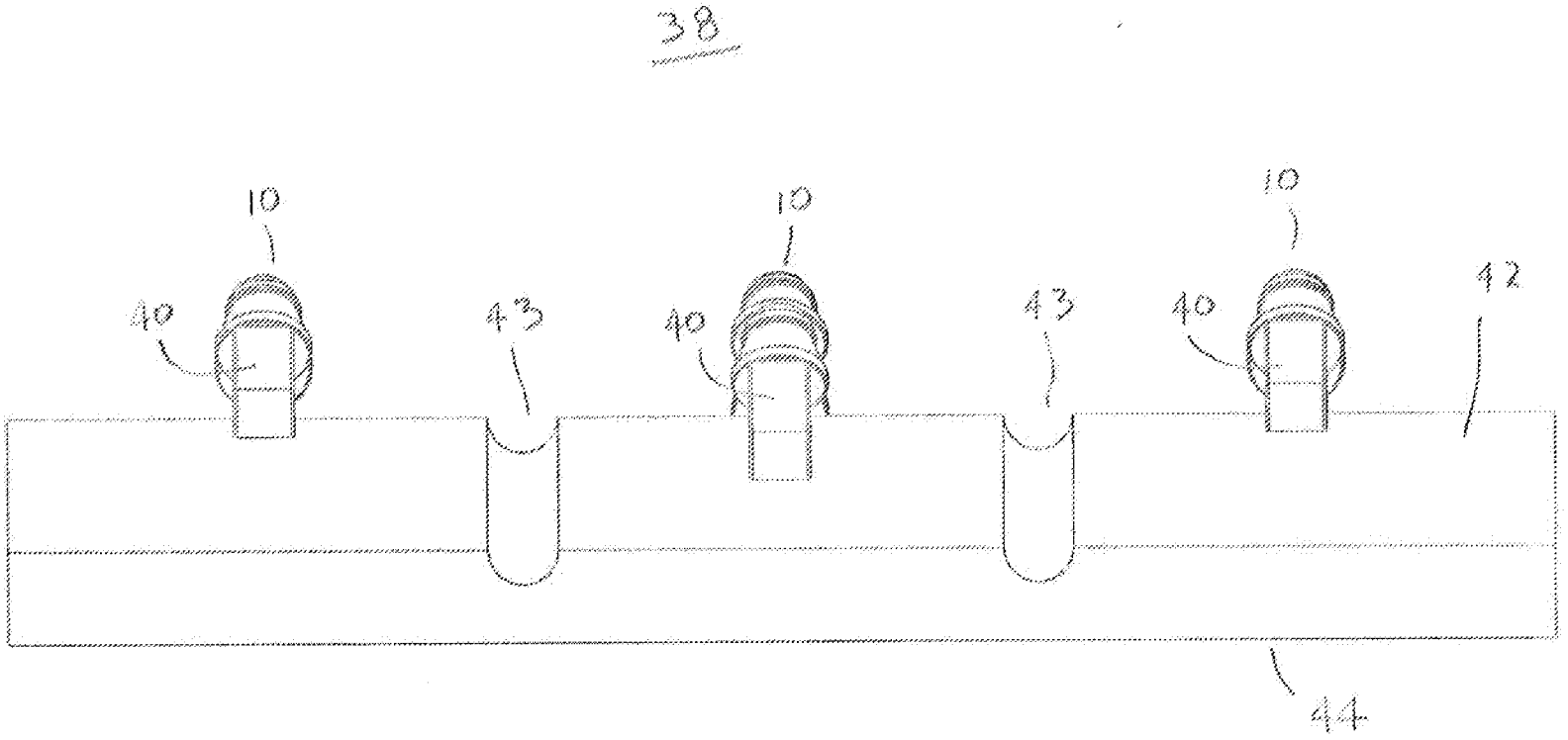
FIG. 13 is a rear elevation view depicting the roller platen assembly of FIG. 11.
Figure 14:
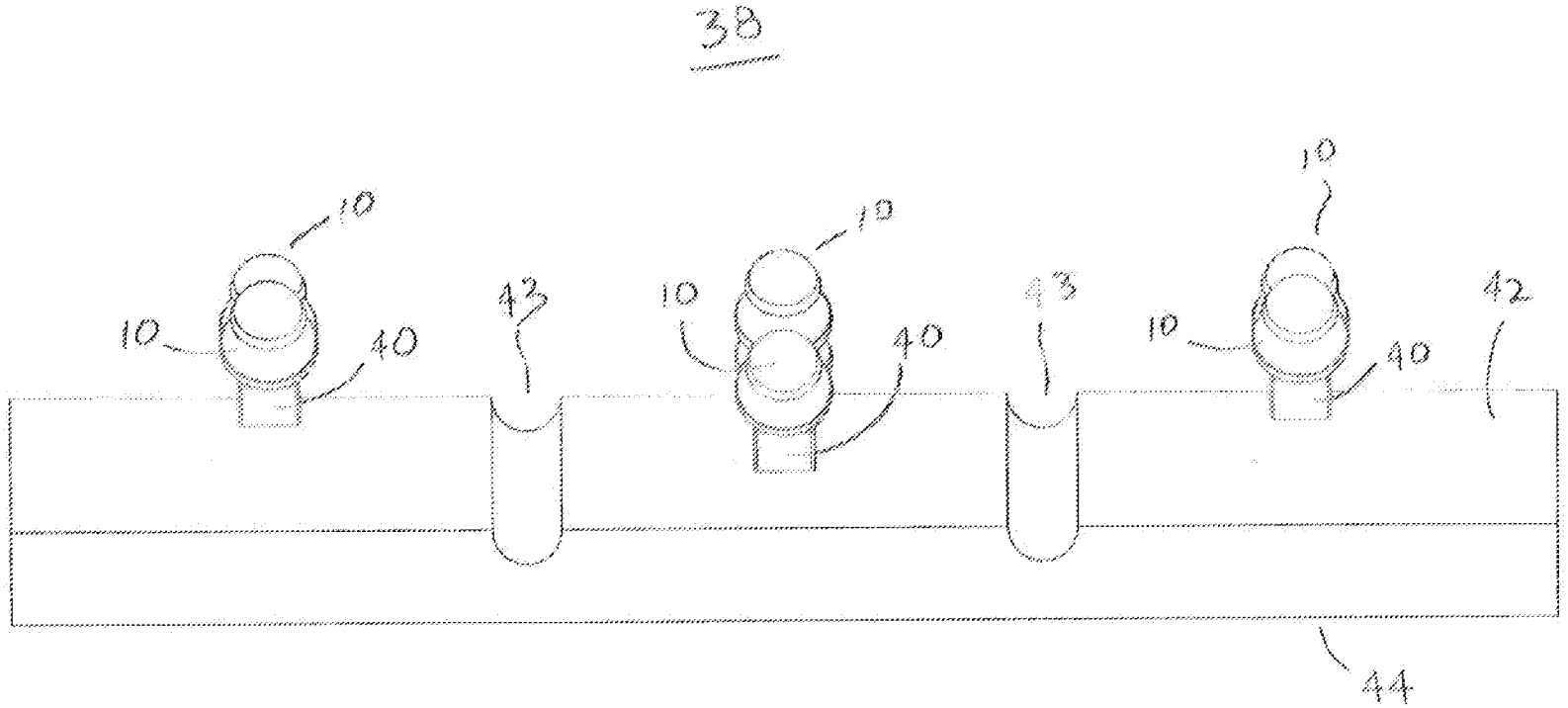
FIG. 14 is a front elevation view depicting the roller platen assembly of FIG. 11.

Referring to FIGS. 8, 9 and 10, tooth 10 is shown with cap 26 and second tungsten carbide layer 34 disposed thereon. In some embodiments, cap 26 can be placed onto tooth 10 after tungsten carbide layer 24 has been disposed onto hemispherical end 20 such that waist 30 contacts terrace 16, thereby forming weld gap 35 so that cap 26 can be welded directly to conical body 12 of tooth 10. In some embodiments, weld gap 35 can be approximately 12 mm to provide sufficient surface area for welding cap 26 to tooth 10. Notch 28 provides means for gas produced by the welding process to escape from beneath cap 26. Once cap 26 has been welded onto tooth 10, second tungsten carbide layer 34 can be applied onto cap 26 using PTAW techniques. In some embodiments, tungsten carbide layer 36 can be applied onto waist 14 of tooth 10 using PTAW techniques.

Referring to FIGS. 11, 12, 13 and 14, an embodiment of tooth platen 38 for a roller crusher is shown. In some embodiments, platen 38 has a plurality of tooth bases 40 disposed on convex surface 42 of platen 38. Each tooth base 40 can be configured to releasably receive an improved tooth 10, as described above. In some embodiments, each tooth base 40 has a machined hole to receive the attachment end 22 of a tooth 10. A tooth 10 can be secured in a tooth base 40 by a bolt threaded into a threaded hole disposed in tooth base 40 into notch 23 disposed on attachment end 22. Platen 38 further has grooves 43 disposed on convex surface 42.

Figure 15:
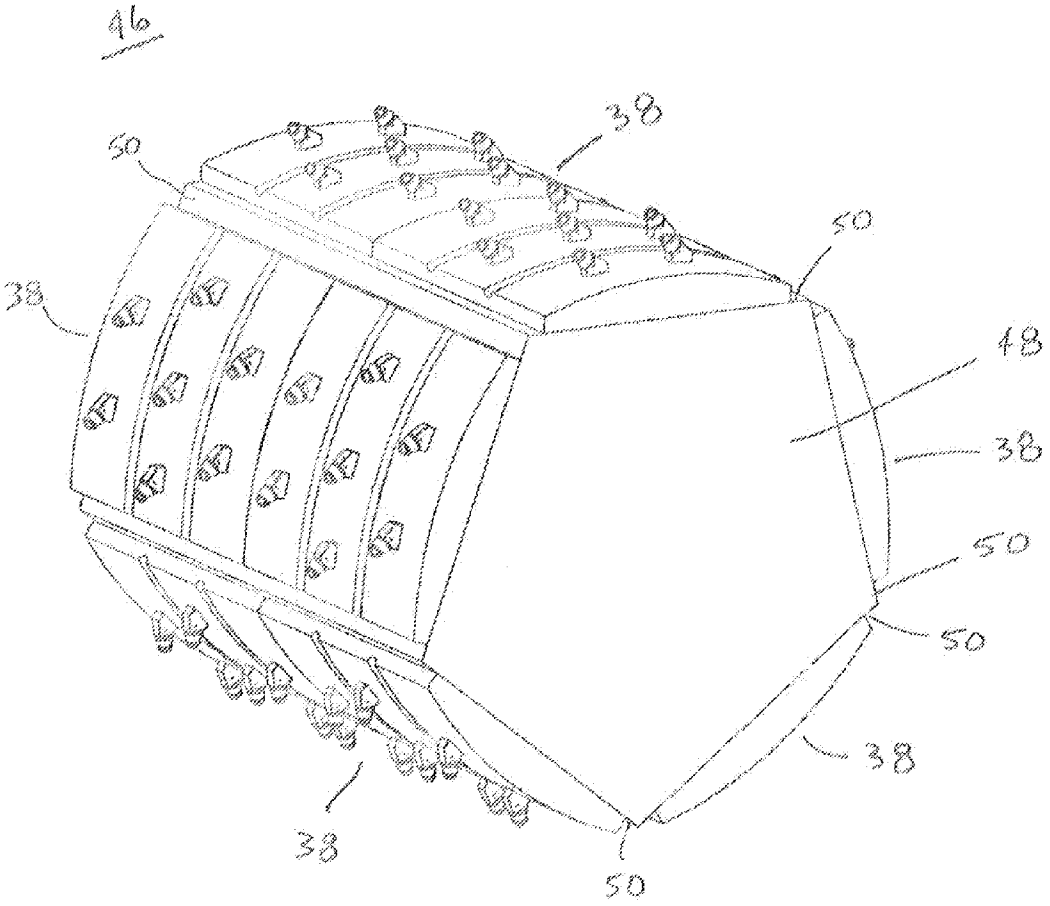
FIG. 15 is a perspective view depicting a roller crusher having a plurality of the roller platen assemblies of FIG. 11.
Figure 16:
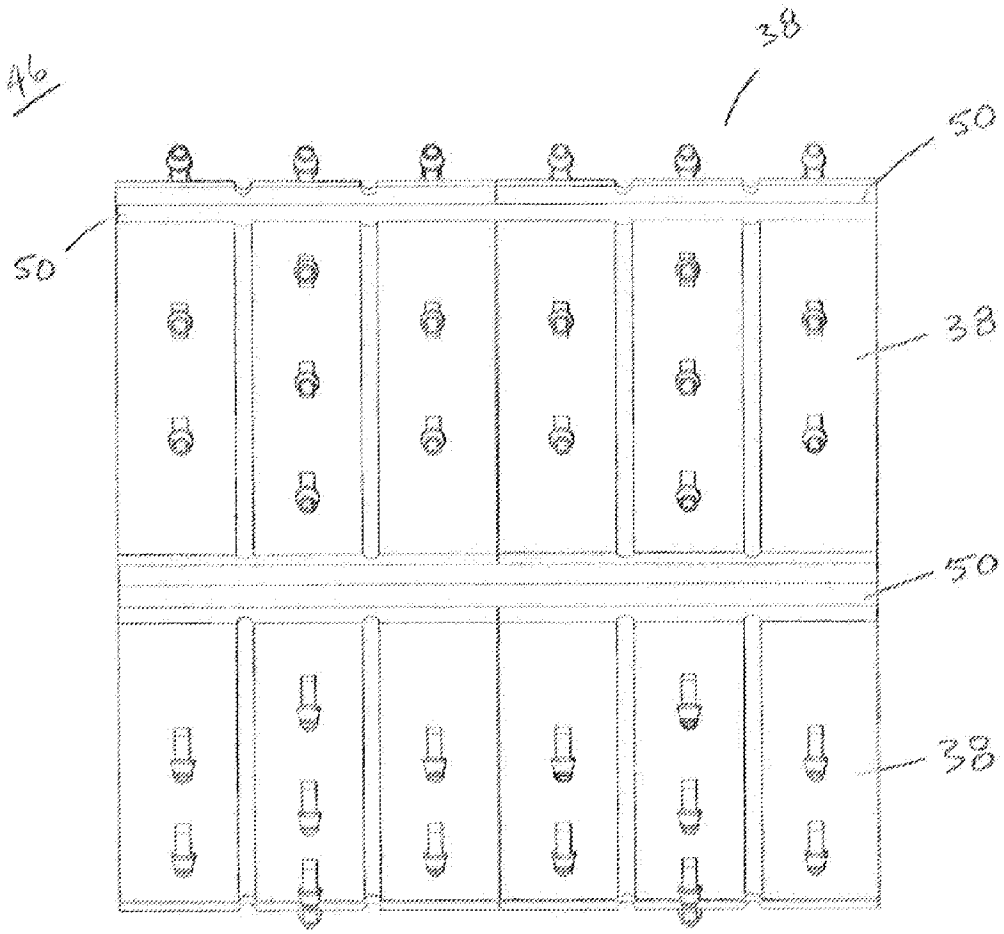
FIG. 16 is a front elevation view depicting the roller crusher of FIG. 15.

Referring to FIGS. 15, 16 and 17, an embodiment of roller crusher 46 is shown. In some embodiments, crusher 46 has drum 48 which has a plurality of surfaces 50 configured to receive platens 38 that can be bolted to surfaces 50. Each platen 38 has a plurality of improved teeth 10 disposed thereon. In some embodiments, drum 48 has five surfaces 50 so as to receive five platens 38.

Figure 19:
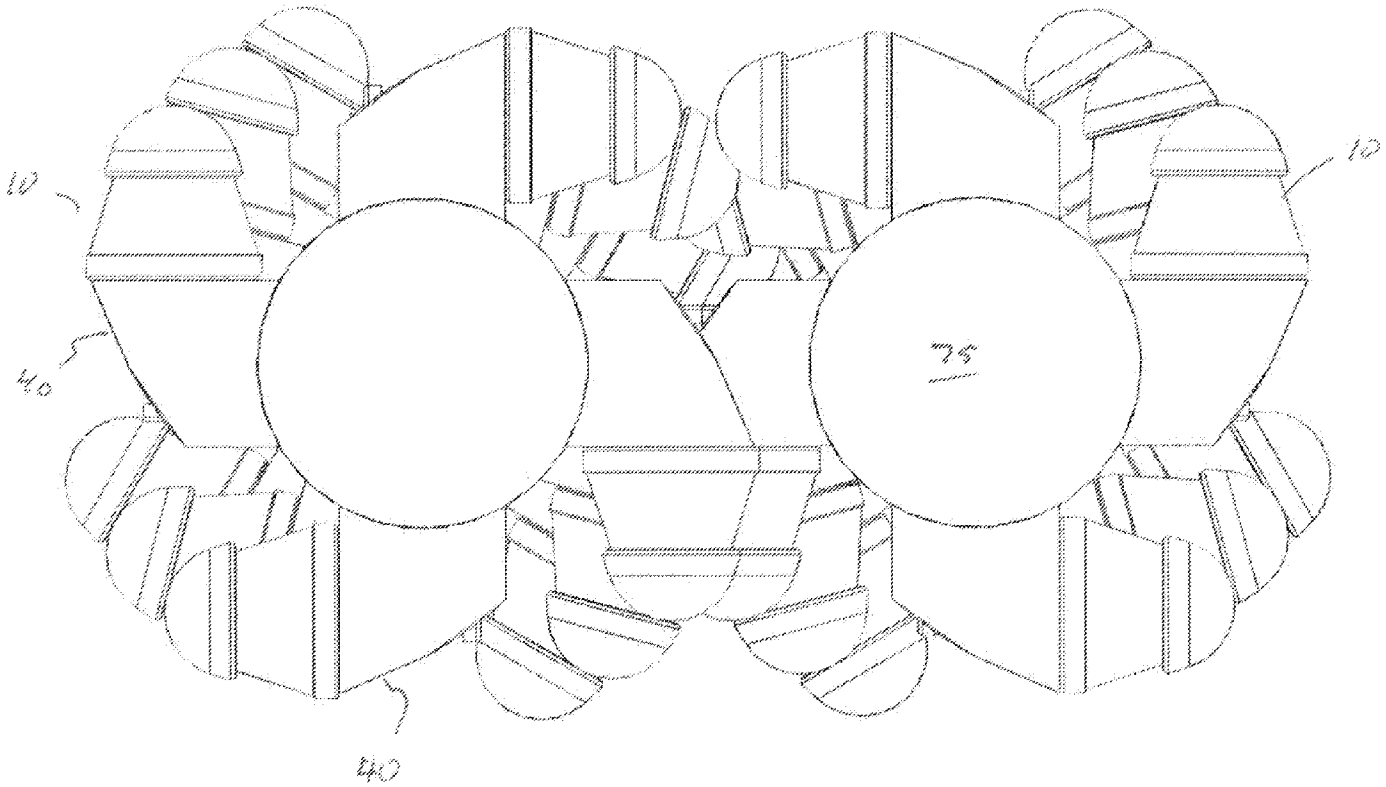
FIG. 19 is a top view depicting the mineral sizer of FIG. 18.
Figure 19:
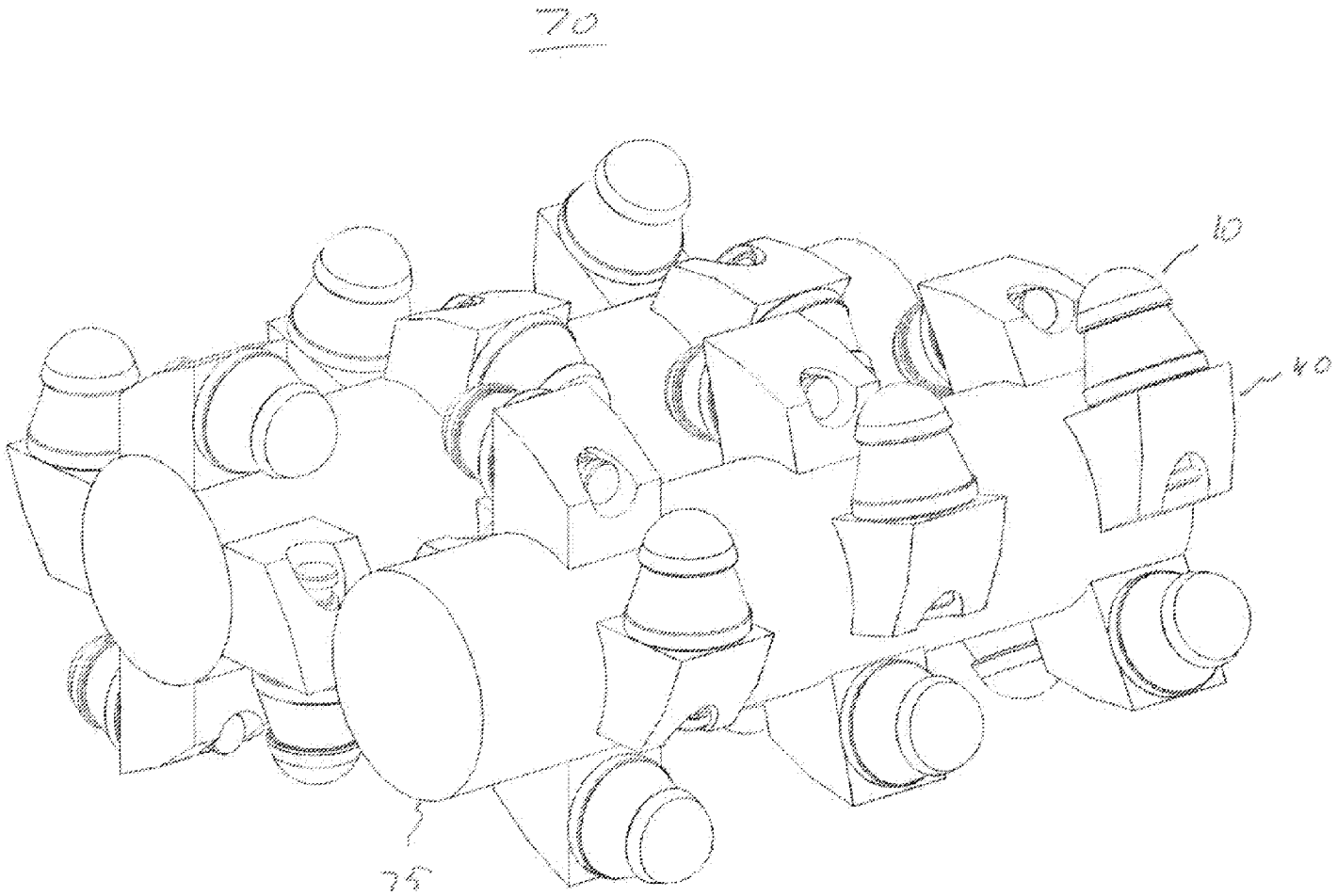
Figure 20:
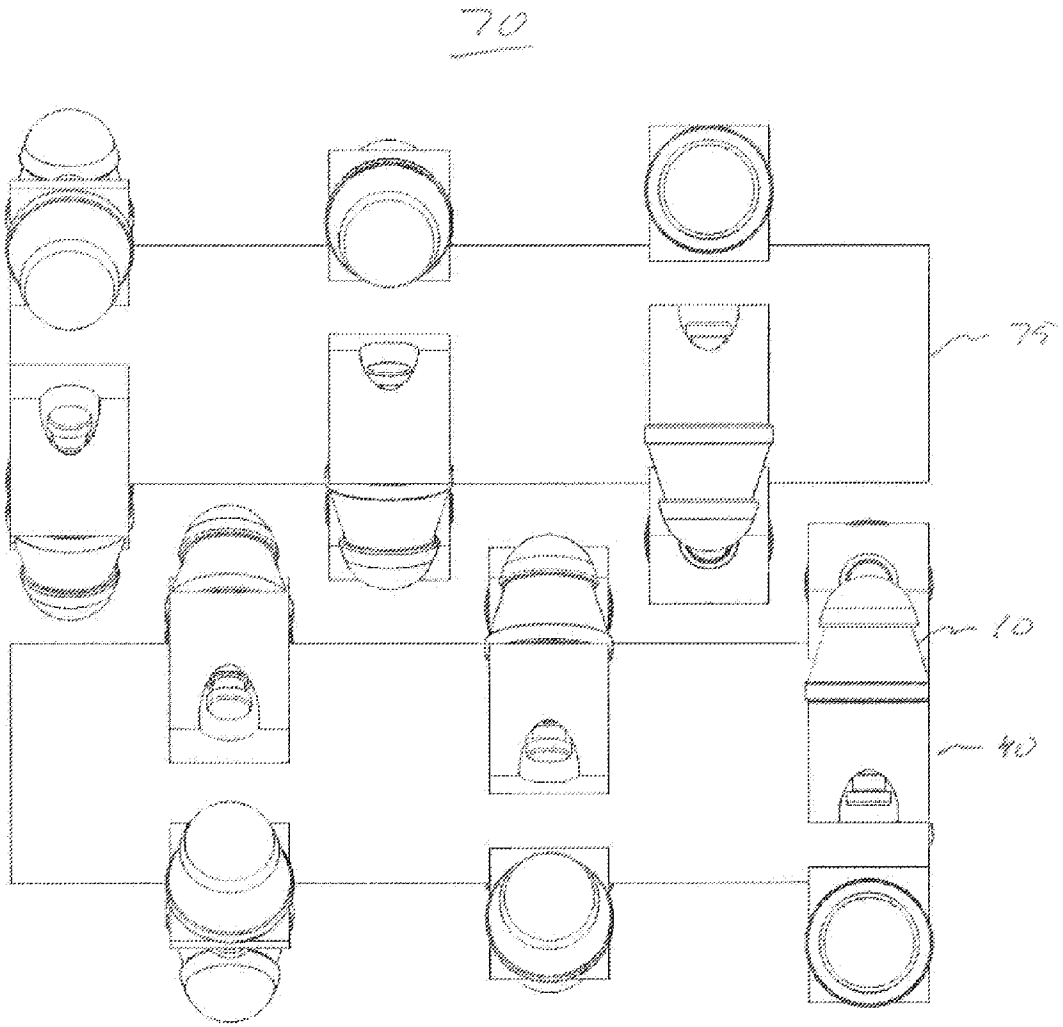
FIG. 20 is a perspective view depicting the mineral sizer of FIG. 18.

The above description references improved teeth 10 in relation to a crusher 46. However, teeth 10 may also be used with mineral sizers 70, as shown in FIGS. 18, 19, and 20.

Teeth 10 used in mineral sizers 70 are slightly smaller than those used with crushers 46. Teeth 10, when used with mineral sizers 70, may be welded to the tooth bases 40 or may be attached to bases 40 as described above in relation to crushers. Bases 40 are positioned on rotating shafts 75.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed:

1. A tooth for a roller crusher, the tooth comprising:

a) an attachment end configured for releasable attachment to the roller crusher, a waist and a conical body extending from the waist away from the attachment end;

b) a recessed hemispherical end disposed on the conical body;

c) a first terrace disposed on the tooth adjacent to the recessed spherical end;

d) a second terrace disposed on the tooth between the first terrace and the conical body;

e) a first tungsten carbide layer disposed on the spherical end;

f) a cap disposed on the spherical end, the cap covering the first tungsten carbide layer; and g) a second tungsten carbide layer disposed on the cap.

2. The tooth as set forth in claim 1, wherein the first tungsten carbide layer abuts the first terrace.

3. The tooth as set forth in claim 1, wherein the cap is welded to the tooth.

4. The tooth as set forth in claim 1, wherein one or both of the first and second tungsten carbide layers are plasma-transfer arc welded to the tooth.

5. The tooth as set forth in claim 1, wherein the cap abuts the second terrace.

6. An improved platen for a roller crusher, the platen comprising a bottom surface for attachment to the roller crusher and a convex surface disposed above the bottom surface, the platen further comprising a plurality of tooth bases disposed on the convex surface, the improvement comprising at least one improved tooth disposed in one of the tooth bases, each improved tooth comprising:

a) an attachment end configured for releasable attachment to one of the tooth bases, a waist and a conical body extending from the waist away from the attachment end;

b) a recessed hemispherical end disposed on the conical body;

c) a first terrace disposed on the tooth adjacent to the recessed spherical end;

d) a second terrace disposed on the tooth between the first terrace and the conical body;

e) a first tungsten carbide layer disposed on the spherical end;

f) a cap disposed on the spherical end, the cap covering the first tungsten carbide layer; and g) a second tungsten carbide layer disposed on the cap.

7. The improved platen as set forth in claim 6, wherein the first tungsten carbide layer abuts the first terrace.

8. The improved platen as set forth in claim 6, wherein the cap is welded to the tooth.

9. The improved platen as set forth in claim 6, wherein one or both of the first and second tungsten carbide layers are plasma-transfer arc welded to the tooth.

10. The improved platen as set forth in claim 6, wherein the cap abuts the second terrace.

11. An improved roller crusher, the crusher comprising a drum configured to receive a plurality of platens, each platen comprising a bottom surface for attachment to the roller crusher and a convex surface disposed above the bottom surface, the platen further comprising a plurality of tooth bases disposed on the convex surface, the improvement comprising at least one improved tooth disposed in one of the tooth bases, each improved tooth comprising:

a) an attachment end configured for releasable attachment to one of the tooth bases, a waist and a conical body extending from the waist away from the attachment end;

b) a recessed hemispherical end disposed on the conical body;

c) a first terrace disposed on the tooth adjacent to the recessed spherical end;

d) a second terrace disposed on the tooth between the first terrace and the conical body;

e) a first tungsten carbide layer disposed on the spherical end;

f) a cap disposed on the spherical end, the cap covering the first tungsten carbide layer; and g) a second tungsten carbide layer disposed on the cap.

12. The improved roller crusher as set forth in claim 11, wherein the first tungsten carbide layer abuts the first terrace.

13. The improved roller crusher as set forth in claim 11, wherein the cap is welded to the tooth.

14. The improved roller crusher as set forth in claim 11, wherein one or both of the first and second tungsten carbide layers are plasma-transfer arc welded to the tooth.

15. The improved roller crusher as set forth in claim 11, wherein the cap abuts the second terrace.

16. A tooth comprising:

a) an attachment end configured for attachment to a base, a waist and a conical body extending from the waist away from the attachment end;

b) a recessed hemispherical end disposed on the conical body;

c) a first terrace disposed on the tooth adjacent to the recessed spherical end;

d) a second terrace disposed on the tooth between the first terrace and the conical body;

e) a first tungsten carbide layer disposed on the spherical end; and f) a cap disposed on the spherical end, the cap covering the first tungsten carbide layer.

17. The tooth of claim 16 further comprising a second tungsten carbide layer disposed on the cap.

18. The tooth of claim 17 wherein one or both of the first and second tungsten carbide layers are plasma-transfer arc welded to the tooth.

19. The tooth of claim 16 wherein the first tungsten carbide layer abuts the first terrace.

20. The tooth of claim 16 wherein the cap is welded to the tooth.

21. The tooth of claim 16, wherein the cap abuts the second terrace.

22. The tooth of claim 16 wherein the base is positioned in a mineral sizer.

23. The tooth of claim 16 wherein the tooth is releasably attachable to the base.

* * * * *